US005933985A

United States Patent [19]

James

[11] Patent Number: 5,933,985

[45] **Date of Patent: *Aug. 10, 1999**

[54] ARTICLE OF FOOTWEAR

[76] Inventor: Laurence H. James, 166 Byram Shore Rd., Greenwich, Conn. 06830

[ * ] Notice: This patent is subject to a terminal disclaimer.

[21] Appl. No.: 09/145,353

[22] Filed: Sep. 1, 1998

Related U.S. Application Data

[62] Division of application No. 08/868,894, Jun. 4, 1997, Pat. No. 5,829,169, which is a division of application No. 08/506,114, Jul. 24, 1995, Pat. No. 5,651,197.

[51] Int. Cl.[6] ..... A43C 11/00

[52] U.S. Cl. ..... 36/50.1; 36/88; 36/50.5

[58] Field of Search ..... 36/50.1, 88, 50.5, 36/55, 89, 91

[56] References Cited

U.S. PATENT DOCUMENTS

| | | | |
|---|---|---|---|
| 2,494,964 | 1/1950 | Rome | 36/2.5 |
| 3,613,271 | 10/1971 | Geller | 36/2.5 |
| 3,654,670 | 4/1972 | Baso | 24/70 SK |
| 3,939,583 | 2/1976 | Daumann | 36/2.5 R |
| 4,051,611 | 10/1977 | Chalmers | 36/50.1 |
| 4,190,969 | 3/1980 | Baso | 36/50.5 |
| 4,384,413 | 5/1983 | Bourque | 36/115 |
| 4,467,538 | 8/1984 | Olivieri | 36/121 |
| 4,476,639 | 10/1984 | Zaccaria | 36/114 |
| 4,534,122 | 8/1985 | MacPhail | 36/88 |
| 4,535,554 | 8/1985 | De Obaldia B. | 36/113 |
| 4,550,511 | 11/1985 | Gamm | 36/50 |
| 4,559,722 | 12/1985 | Norton | 36/89 |
| 4,679,334 | 7/1987 | McBride | 36/114 |
| 4,777,741 | 10/1988 | James | 36/114 |
| 4,811,500 | 3/1989 | Maccano | 36/91 |
| 4,972,613 | 11/1990 | Loveder | 36/105 |
| 5,117,767 | 6/1992 | Berger | 36/50.1 |
| 5,177,882 | 1/1993 | Berger | 36/54 |
| 5,243,772 | 9/1993 | Francis et al. | 36/114 |
| 5,251,388 | 10/1993 | Pozzobon et al. | 36/50.5 |
| 5,276,983 | 1/1994 | Hatfield | 36/136 |
| 5,317,820 | 6/1994 | Bell et al. | 36/89 |
| 5,319,868 | 6/1994 | Hallenbeck | 36/54 |
| 5,325,613 | 7/1994 | Sussmann | 36/50.1 |
| 5,327,662 | 7/1994 | Hallenbeck | 36/50.1 |
| 5,379,530 | 1/1995 | Bell et al. | 36/89 |
| 5,392,535 | 2/1995 | Van Noy et al. | 36/88 |
| 5,416,987 | 5/1995 | Bermis et al. | 36/50.1 |
| 5,502,902 | 4/1996 | Sussman | 36/50.1 |
| 5,647,104 | 7/1997 | James | 36/50.1 |
| 5,651,197 | 7/1997 | James | 36/50.1 |

*Primary Examiner*—M. D. Patterson
*Attorney, Agent, or Firm*—Wall, Marjama, Bilinski & Burr

[57] ABSTRACT

An article of footwear having an upper connected to a sole, wherein an integrated tongue-strap structure is provided for superior fit, durability, support and strength. The upper may be formed of at least two layers, including an upper body having a heel portion, an arch and instep portion and a toe portion for respectively receiving a heel, an arch and instep and toes of a foot of a wearer. The strap element may penetrate the upper body, extend around the upper body between those two layers from medial to lateral sides of the article of footwear. The strap element may be formed of one-piece. In such a case, the footwear is donned by loosening a tensioning device provided on the tongue of the upper or provided between at least one end of the one-piece strap element and the tongue.

12 Claims, 16 Drawing Sheets

ARTICLE OF FOOTWEAR

This is a division of application Ser. No. 08/868,894, filed Jun. 4. 1997, now U.S. Pat. No. 5,829,169 which in turn is a division of 08/506,114, filed Jul. 24, 1995, now U.S. Pat. No. 5,651,197. Both prior applications are hereby incorporated herein by reference.

BACKGROUND OF THE INVENTION

The present invention relates generally to footwear, and particularly, footwear having enhanced support features integrally designed into their construction. More specifically, the present invention contemplates use of an integrated tongue-strap structure adapted to apply even pressure around the foot and/or ankle of the wearer to provide enhanced fit and support.

Footwear designers have aspired to produce footwear having superior fit and support. Nowhere is this more prevalent than in the athletic footwear industry as evidenced by various earlier footwear embodiments for basketball, jogging, football, etc., and even in ice-skating. In addition, there has been increased attention to bicycling footwear, particularly to the quality of construction of the upper of bicycle footwear which is subjected to enormous force during the upward pulling stroke of the bicycle rider. Accordingly, the present invention also contemplates provision of an article of footwear having an upper which has superior durability and strength.

An example of athletic footwear having improved support features is shown in U.S. Pat. No. 4,450,511 to Gamm. Gamm discloses a running shoe having an instep strap which extends through the midsole of a running shoe inside the body of the upper. Opposite ends of the strap have hook and loop fasteners, and the strap is intended to wrap directly around the foot of the wearer. However, the instep support strap according to Gamm suffers from numerous drawbacks. For example, the fit of the upper of the shoe is not largely enhanced by the strap, since it extends inside and directly surrounds the foot. In addition, the strap is likely to affect circulation through the foot, as pressure is not evenly distributed throughout a top or dorsal area of the foot. In addition, the interior strap of Gamm requires burdensome manipulation by the wearer.

U.S. Pat. No. 4,972,613 to Loveder discloses a rear entry athletic shoe using a ski-binding type mechanism which utilizes an adjustable strap that wraps around an aft portion of the shoe. This design provides only marginal increased support through the upper.

U.S. Pat. No. 5,243,772 to Francis et al. discloses an article of athletic footwear having increased support, by providing an integral external shell that wraps around a sock but is not connected thereto. The external shell of this invention is tightened around the sock and wearer's foot by means of a conventional lace-type closure system connecting opposing edges of the shell, over a tongue portion of the sock. However, a need still exists for additional support along the dorsal portion of the foot and superior fit around the ankle and heel portions of the upper.

U.S. Pat. Nos. 2,494,964 to Rome, U.S. Pat. No 4,476,639 to Zaccaria and U.S. Pat. No. 3,613,271 to Geller disclose other shoe designs incorporating straps but continue to fail to meet the rigorous demands of support, fit and durability demanded by the marketplace. Of these patents, those to Rome and Geller utilize a strap secured to the tongue of a shoe. However, the straps are formed of essentially two segments which are separable from each other to allow the tongue to release and permit the wearer in donning or removing the shoe. The separable two-piece straps are particularly disadvantageous since they do not provide adequate support and require burdensome manipulation. In addition, the straps merely extend around an outer surface of the upper, perhaps through a pull tab strictly provided on an aft portion of the shoe upper as taught by Rome. Such structures do not provide adequate support.

SUMMARY OF THE INVENTION

The present invention has been developed to overcome the deficiencies of the prior art, and provide an article of footwear having superior fit, strength, durability and support. According to the present invention, an integrated tongue-strap structure is provided to give unparalleled support, fit and durability. The strap which fully wraps around the upper body and which is integrated with the tongue, provides a glove-like fit, distributing pressure along a lower shin portion, a rear foot or ankle portion, a substantial area of the dorsal surface including the lateral and medial sides, and sole portions of the foot, concentrically and controlled by an amount of tension applied to the strap.

According to a first aspect of the present invention, an article of footwear is provided, comprising an upper formed of at least two layers and including (i) an upper body including a heel portion, an instep portion and a toe portion for respectively receiving a heel, an instep, and toes of a foot of a wearer, and (ii) a tongue for covering the dorsal portion of the foot including the lateral and medial aspects thereof; a sole or other hardware connected to the upper; a strap element penetrating the upper body and extending between two layers of the upper body from medial to lateral sides thereof, the strap element having first and second opposite ends respectively secured to opposite lateral sides of the tongue to form an integrated strap-tongue structure; and tensioning means for adjusting tension of the strap element.

According to a second aspect of the present invention, an article of footwear is provided, comprising an upper including (i) an upper body including a heel portion, an instep portion and a toe portion for respectively receiving a heel, an instep, and toes of a foot of a wearer, and (ii) a tongue attached to the upper body, for covering a dorsal portion of the foot; a sole connected to the upper; a one-piece strap element having first and second opposite ends respectively secured to opposite lateral sides of the tongue to form an integrated strap-tongue structure; and tensioning means for adjusting tension of the strap element.

According to a third aspect of the invention, an article of footwear is provided, comprising an upper including (i) an upper body including a heel portion, an arch and instep portion and a toe portion for respectively receiving a heel, an arch and instep and toes of a foot of a wearer, and (ii) a tongue for covering the dorsal portion of the foot including the lateral and medial aspects thereof; a sole or other hardware connected to the upper; a one-piece strap element extending between the upper body and the sole, the strap element including first and second opposite ends respectively secured to opposite lateral sides of the tongue to form an integrated strap-tongue structure; and tensioning means for adjusting tension of the strap element.

According to the first aspect of the present invention, since the strap element extends between at least two layers of the upper, around the upper body from medial to lateral sides thereof, pressure around an ankle portion or heel portion (from medial to lateral sides thereof) is evenly distributed. In addition, since the strap penetrates the upper extends therein through a substantial portion thereof so as to extend along a through-direction, orientation of the strap may be securely maintained along a direction perpendicular to the through direction of the strap.

According to the second and third aspects of the present invention, an article of footwear which is easy to don without requiring separation of straps via buckles, VELCRO or ratcheting mechanisms, thereby contributing to the superior support provided by the present invention. Those advantages are realized by utilizing a one-piece strap, an extended section of material which is not severable, such as by an intermediate buckle or by a hook and loop fastener. The one-piece strap may, however, be formed of a number of layers of the same or different materials, or suitable sections of different materials connected together so as to include reinforced portions, for example. According to the present invention, a one-piece strap is effectively utilized while the prior art relies on severable straps to release the foot from the upper.

Preferably, the strap element according to all aspects of the present invention is free floating, that is, is freely slidable between layers of the upper or between the upper and the outsole. According to this particularly preferable feature, the relative position of the tongue may be freely moved to conform to the dorsal portion of the foot of the wearer. Preferably, a plurality of strap elements are provided. For example, in a high-top embodiment of the present invention, ankle, heel and midfoot straps may be utilized, each of which is integrated with the tongue of the upper.

The present invention also contemplates a unique cinching mechanism, which may be adapted to tension the straps of the article of footwear according to the first, second and third aspects of the present invention. The cinching mechanism includes a device for pulling first and second members together, comprising a closed-loop cable connecting the first and second members to each other; first guiding means for guiding the cable through first and second symmetrically spaced-apart turns along the first member; second guiding means for guiding the cable through an opposing turn in the second member, wherein the cable forms a closed-loop consecutively extending through the first turn, the opposing turn and the second turn; and a ratchet including a plurality of juxtaposed grooves for receiving the cable, to fix a relative position of the first and second members with each other.

The present article of footwear is not limited to athletic footwear, but may include any article of footwear such as ice-skates, ski boots, bicycling footwear, hiking boots, sandals etc. In addition, the outsole may be formed for virtually any sport, and may be cleated for outdoor sports, have blades for ice-skating, or have lugs for hiking, etc.

DESCRIPTION OF PREFERRED EMBODIMENTS

Figure 1:
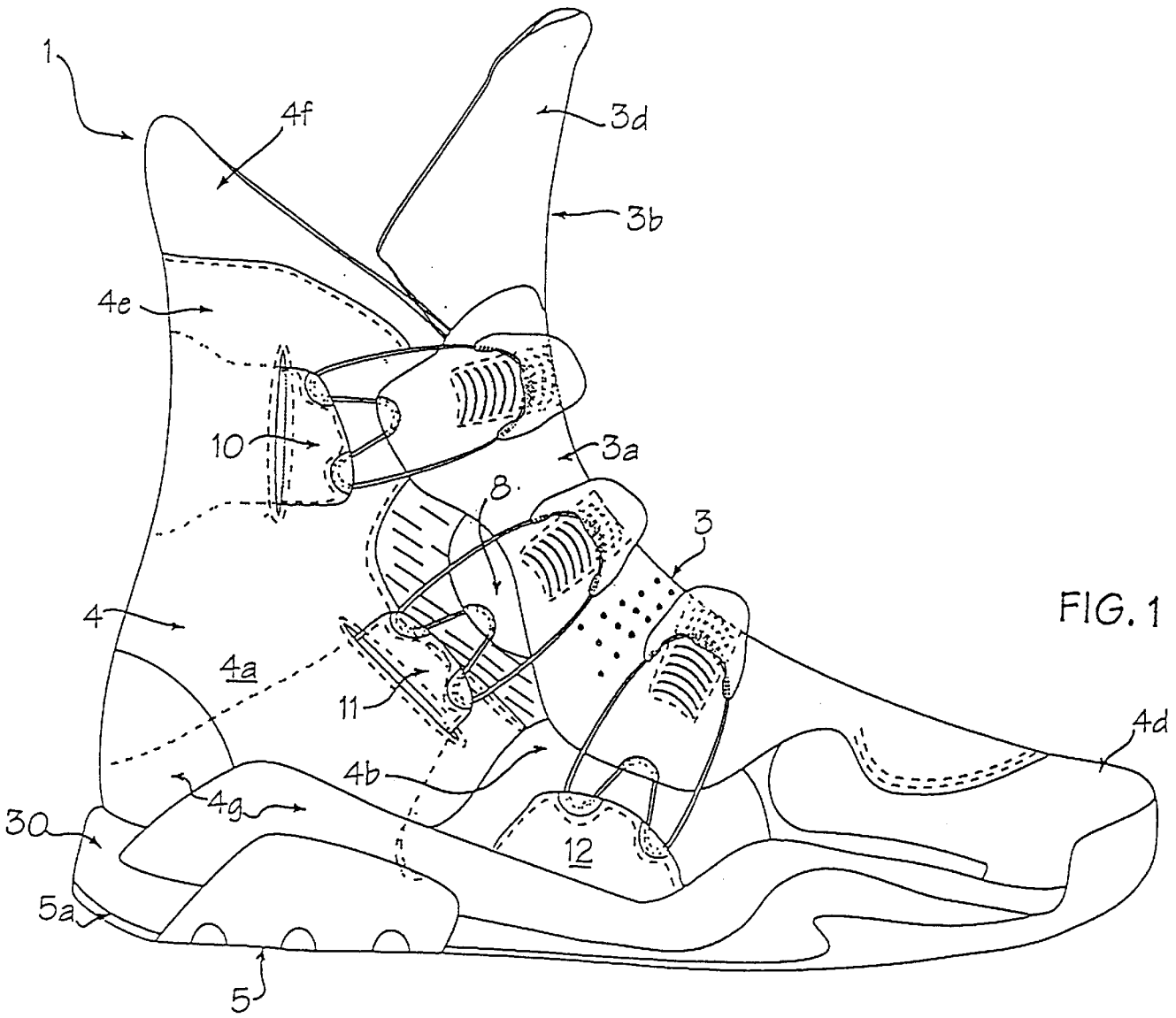
FIG. 1 is a lateral side elevational view of a first embodiment of the present invention having closed cinching devices.

Referring now to the drawings, a description of preferred embodiments of the present invention is set forth. Same reference numerals are utilized among the different embodiments to denote similar structural features.

Figure 2:
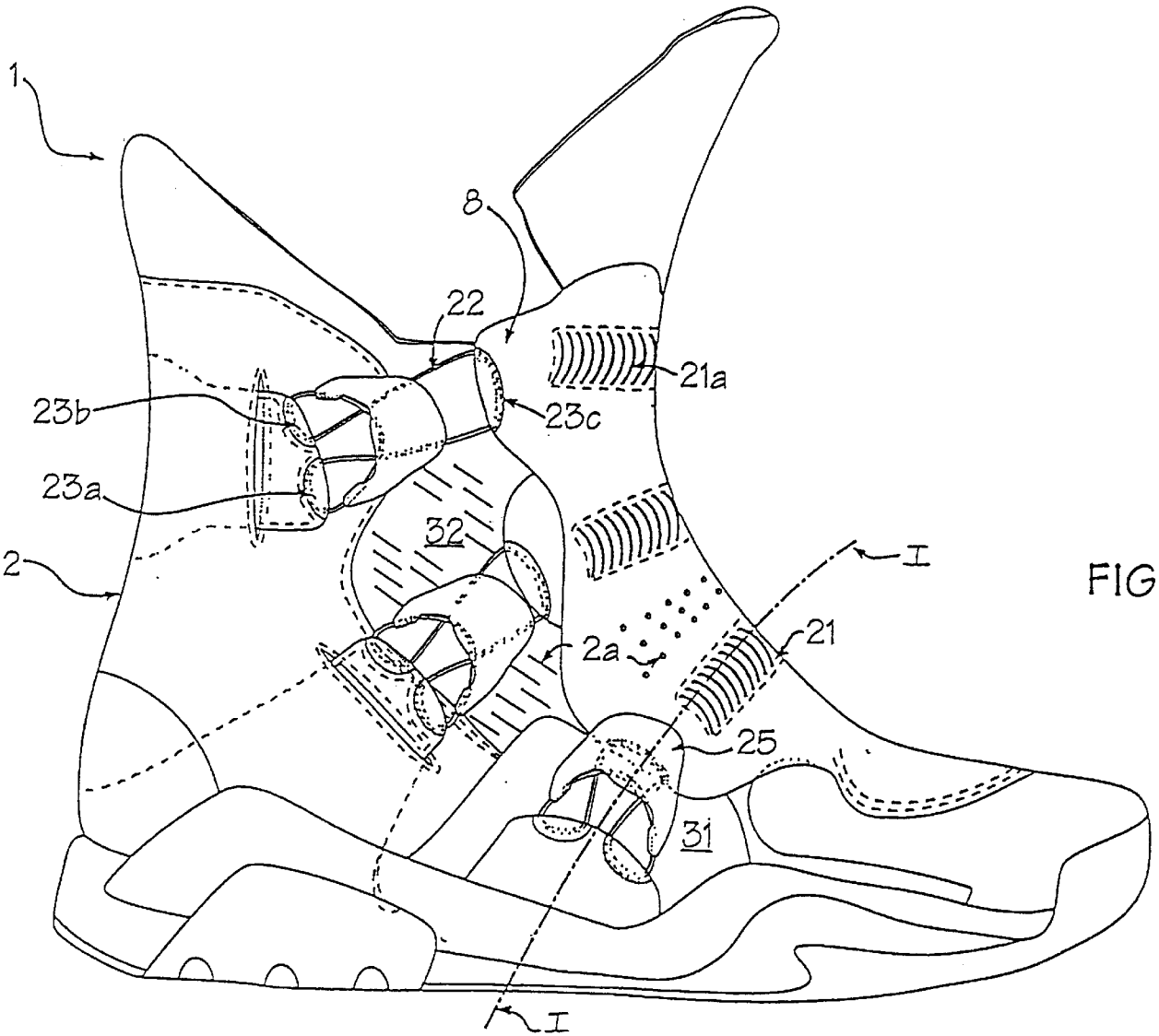
FIG. 2 is a lateral side elevational view of the first embodiment of the present invention disclosed in FIG. 1, having released cinching devices provided between respective straps and the tongue.
Figure 3:
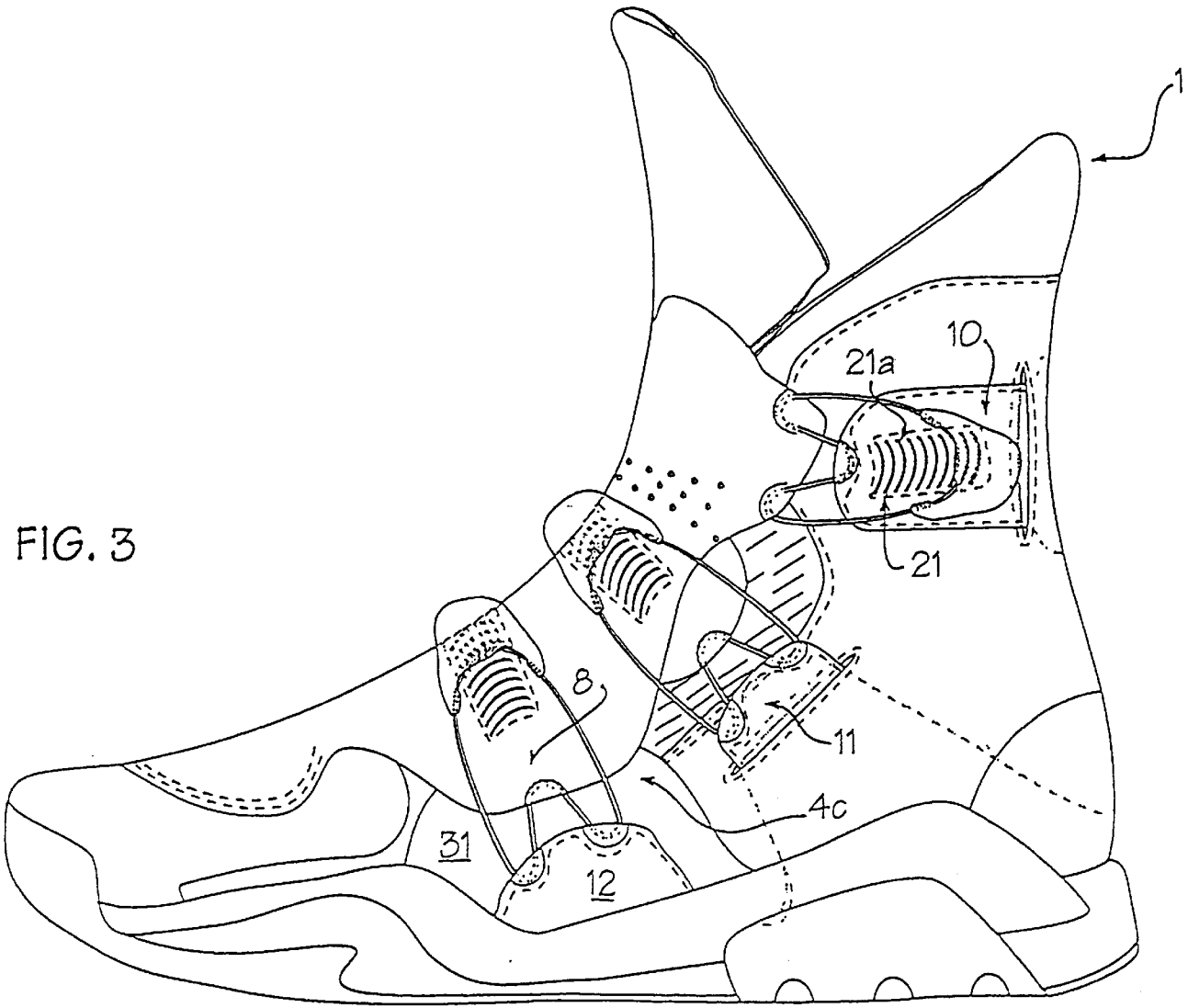
FIG. 3 is a medial side elevational view of the first embodiment disclosed in FIG. 1, having closed cinching devices.

FIGS. 1–3 illustrate a first embodiment, showing first, second and third aspects of the present invention. An article of footwear 1 is provided, comprising an upper 2 which includes tongue 3 and upper body 4. In this embodiment, the tongue includes a tongue overlay 3*a* and a tongue inner 3*b*. Inner surfaces of tongue overlay and tongue inner 3*a*, 3*b* may include padded closed cell foam, to provide added stability and comfort. Preferably, tongue inner 3*b* has a dorsal extension forming shin support 3*d* which aids in donning or removing the article of footwear, discussed below. Upper body 4 includes heel portion 4*a*, instep portion 4*b*, arch portion 4*c* and toe portion 4*d* which respectively wrap around and receive the heel, instep and toes, respectively, of the foot of the wearer. The first embodiment of the present invention shown in FIGS. 1–3 discloses high-top or mid-height athletic footwear that provides additional support to the wearer around ankle portion 4*e* which receives the ankle of the wearer. A sole 5 is connected to upper body 4 and is adapted for contacting a ground surface. In addition, a midsole 30 may be further provided between the outsole 5*a* and the upper 2, illustrated in FIGS. 4–6.

Figure 7:
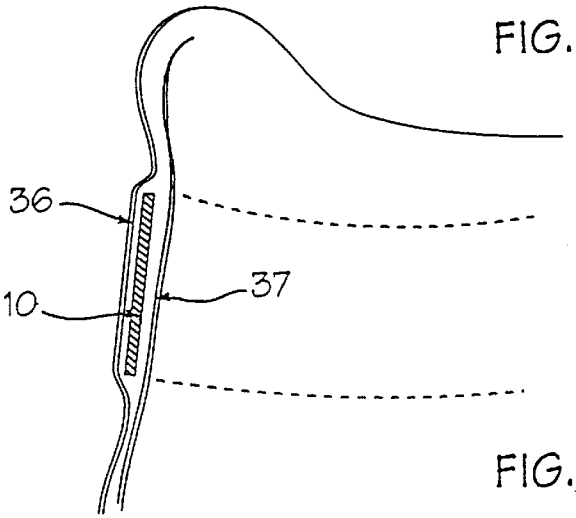
FIG. 7 is a partial sectional view disclosing the extension of the ankle strap of the first embodiment shown in FIG. 1.

The embodiment shown in FIGS. 1–3 preferably includes an ankle strap 10, a heel strap 11, and an arch and instep strap 12 which extends around the upper body and has opposite ends connected to the tongue 3, particularly to the tongue overlay 3*a* at flanges 8 along medial and lateral aspects thereof. Each of ankle strap 10 and heel strap 11 penetrates into the upper body, and extends between first and second layers 36 and 37 (shown in FIG. 7) around a substantial portion of the upper body, between medial and lateral sides thereof. Another preferable feature of the present article of footwear includes ankle and heel straps 10 and 11 that are freely slidable within the upper body 4, which affords the wearer personalized adjustability throughout the rearfoot of the upper body portion of the upper.

The embodiment shown in FIG. 1 further includes an arch and instep strap 12 which extends between the upper 2 and the sole 5, arch and instep strap 12 having opposite ends each secured to tongue overlay 3*a* in a similar fashion to ankle and heel straps 10 and 11. Arch and instep strap 12 is preferably freely slidable between the upper 2 and the sole 5.

In this first embodiment, upper body 4 extends above ankle portion 4*e*, particularly padded collar 4*f* which reaches an apex along an aft portion of the upper body 4. Collar 4*f* and an opposing portion of the tongue inner 3*b*, shin support 3*d*, cooperate with each other to aid the wearer in donning or removing the article of footwear by providing additional gripping leverage for the wearer. These features are particularly preferable according to the present invention since the straps 10, 11 and 12 may be one-piece members, integrated with the tongue 3, that prevent tongue 3 from fully separating from medial and lateral sides of the upper body 4 (i.e., the integrated structure including tongue 3 and straps 10, 11 and 12 is only partially separable from the upper body 4, straps 10, 11 and 12 maintaining connection to medial and lateral sides of the upper body 4).

Figure 5:
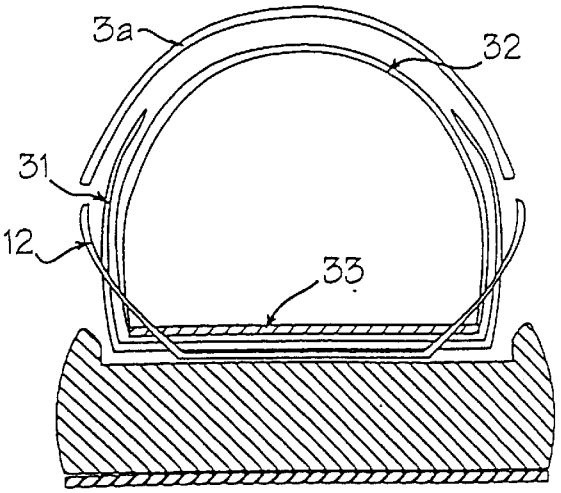
FIG. 5 is a partial cross-sectional view along line A—A of FIG. 2 disclosing the arch and instep strap extending through the inside of the upper allowing for direct contact with the wearer's foot.
Figure 4:
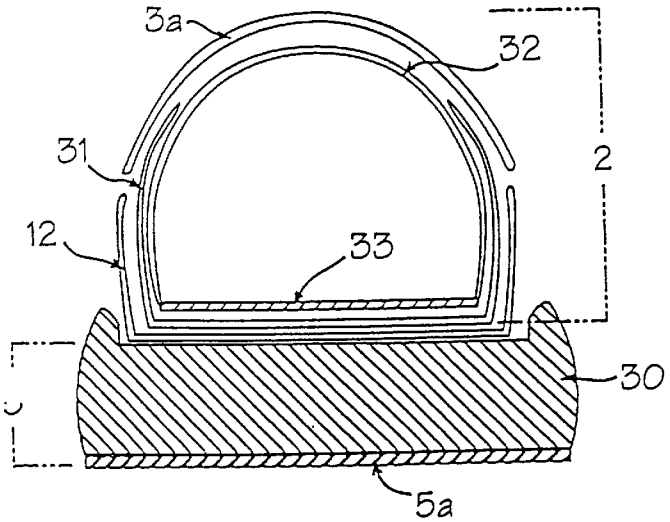
FIG. 4 is a partial cross-sectional view along line A—A of FIG. 2 disclosing the arch and instep strap extending between the upper and midsole.
Figure 6:
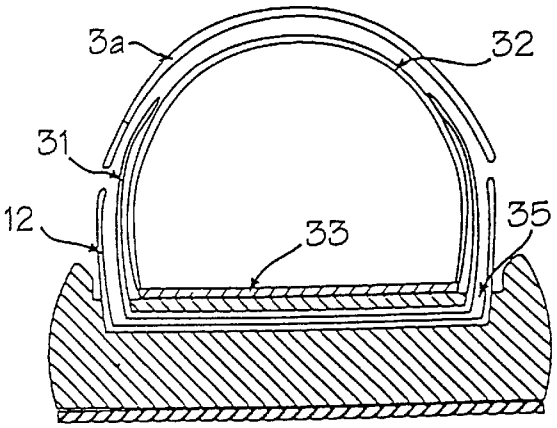
FIG. 6 is a partial cross-sectional view along line A—A of FIG. 2 disclosing the arch and instep strap extending through channels in the midsole.

Referring to FIGS. 4–6, alternative constructions of the extension of the arch and instep strap 12 are shown. As disclosed in FIG. 4, arch and instep strap 12 extends between midsole 30 and orthotic 31 that connects partially to sock liner 32 preferably made from LYCRA or NEOPRENE foam or other breathable mesh material that afford similar high elastic properties and sliplast 33 forming part of the upper 2.

More detailed descriptions of alternative constructions of the arch and instep strap appear in FIGS. 5 and 6. Specifically, the alternative construction shown in FIG. 5, arch and instep strap 12 extends through orthotic 31, sliplast 33 and sock liner 32, essentially so as to partially contact a portion of the foot of the wearer along medial and lateral sides thereof. Referring to FIG. 6, the arch and instep strap 12 extends through channel 35 extending through midsole 30.

The first embodiment shown in FIGS. 1–3 discloses additional features of the present invention directed to the cinch devices 20 which connect first and second opposite ends of each of the straps to opposing lateral sides of the tongue 3, formed by flanges 8 extending from tongue overlay 3*a*. Each of the cinch devices includes a ratchet 21 having a plurality of grooves 21*a* formed therein. Each closed-loop cable 22, extends through guide-forming members 23*a–c* connected to ankle strap 10, heel strap 11 and arch and instep strap 12 at flange 8 respectively to form first, second and third turns in the ends of the straps to form a complete closed-loop cinching system. The cables extend consecutively through first guide member 23*a*, opposing guide member 23*c* and second guide member 23*b* so as to form a closed-loop. Upon pulling pull tab 25, a cinching effect occurs to tighten the tongue 3 onto a dorsal (top) portion of the foot. In addition, the straps are also tensioned, providing a concentric tourniquet-like fitting effect is provided by tightening the cinch devices. After the user determines an appropriate tension, the closed-loop portion of the cable 22 is pushed into an appropriate clip-in groove 21*a* of ratchet 21 and is clipped therein. The ratchets 21 may extend fully around an outer surface of the tongue overlay 3*a*, such that the ratchets 21 are shared by opposing cinching devices. In addition, the orientation of one or more of the cinching devices may be reversed, such that the tab 25 extends toward the respective strap, while the respective ratchet 21 is provided on the strap or upper body 4. See ankle strap 10 shown in FIG. 3. Cables 22 may be formed of an elastic material to allow an elasticized fit precluding any binding on the foot especially during strenuous movements during sports activities. In addition, cables 22 may be replaced by the wearer with cables having a fixed length or differing elastic spring properties to provide a personalized fit. A more detailed description of the particular structure of the closure system is provided in connection with FIGS. 19*a–*20*b* hereinafter.

As shown in FIGS. 1–3, portions of the upper body 4 and tongue 3 may include air vents or breathable mesh material 2*a* for escaping perspiration. The upper body 4 may be formed mainly of natural leather or synthetic leather, for example, while the tongue 3 may include a natural leather tongue inner 3*b* and a reinforced thermoplastic material for example, a resilient polyester or low density polyethylene for tongue overlay 3*a* to provide added support, as appropriate.

Figure 8:
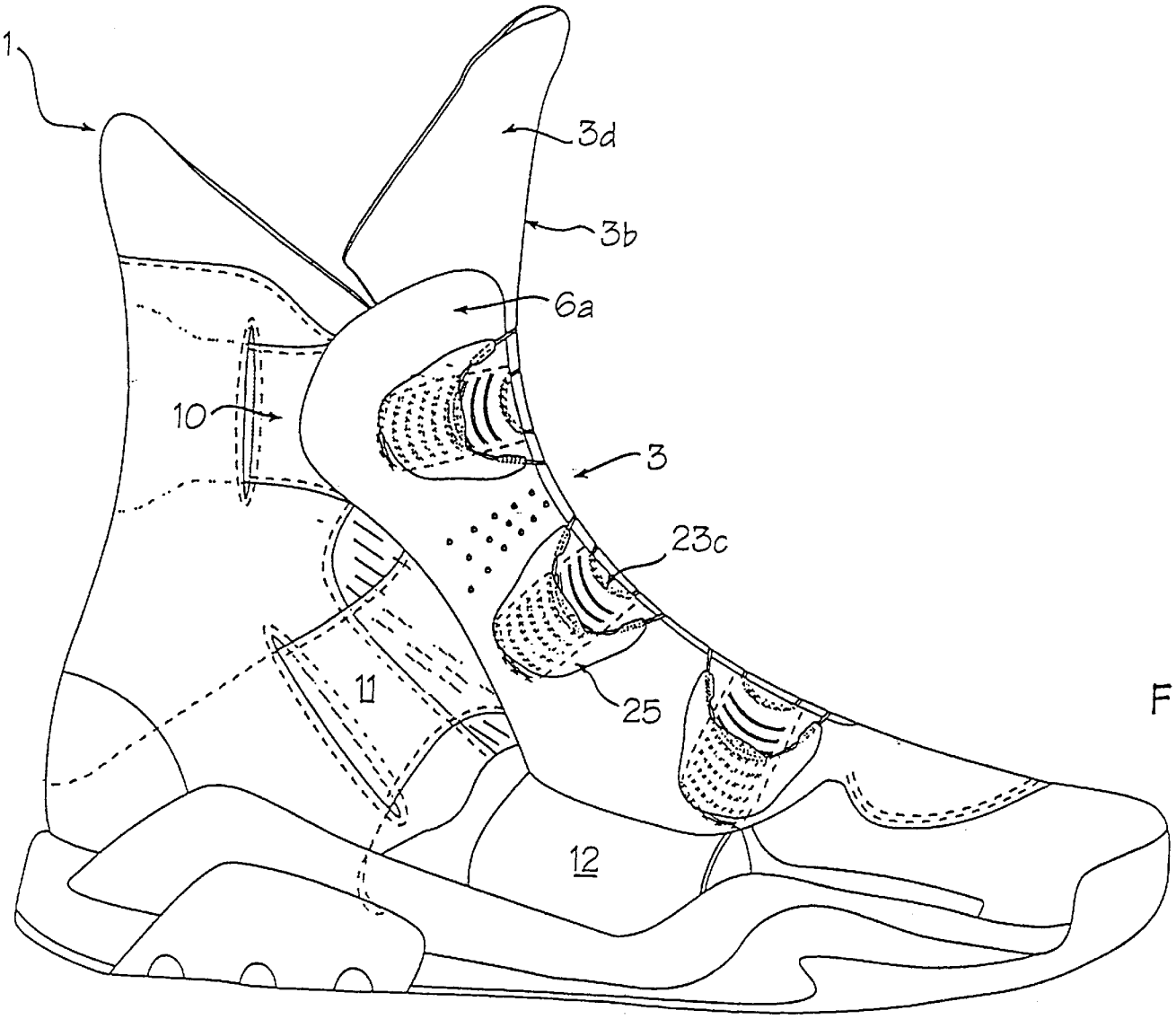
FIG. 8 is a lateral side elevational view of a second embodiment of the present invention disclosed in FIG. 1 providing cinching devices on first and second elongated flange portions of the tongue.
Figure 9:
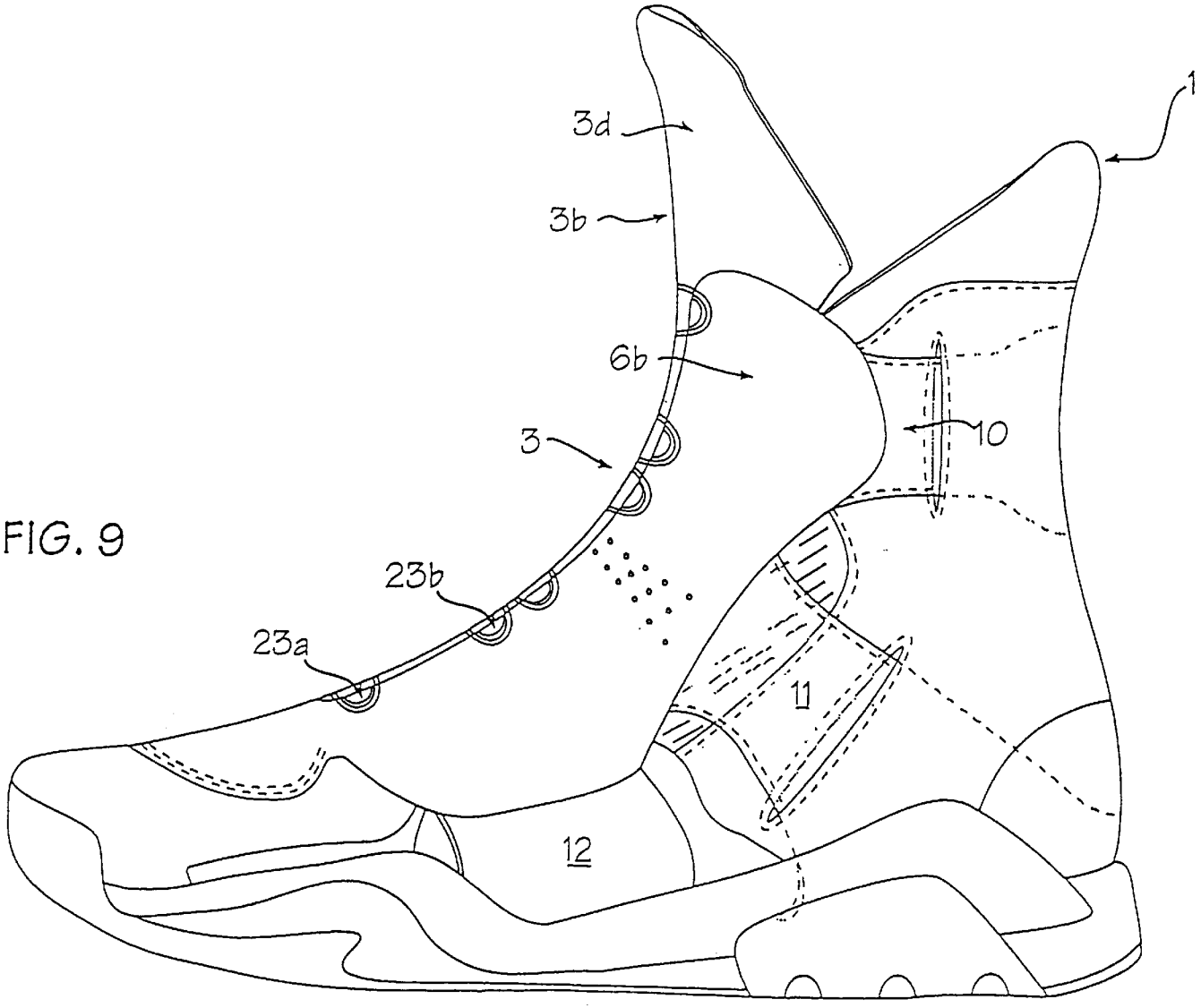
FIG. 9 is a medial side elevational view of the article of footwear disclosed in FIG.8 providing particularly first and second guide members of each cinching device.

FIGS. 8–9 disclose a second embodiment of the present invention, wherein the tongue 3 is modified to include first and second elongated flange portions 6*a*, 6*b* provided to overlap opposing lateral sides of tongue inner 3*b*. In addition, the ankle, heel and arch and instep straps 10, 11 and 12 are secured directly to the first and second elongated flange portions 6*a*, 6*b*, such as by stitching, adhesion or molded integrally with the flange portions. As straps 10–12 are tensioned, the tongue 3 presses against the dorsal portion of the foot, via action of cinching devices, as previously described in connection with the first embodiment. However, in the second embodiment, the cinching devices are provided between the first and second elongated flange portions 6*a*, 6*b* to cinch or bias the flange portions toward each other. It is noted that the orientation of one or more of the cinching devices may be reversed, such that the tabs 25 face medially or towards inside of the article of footwear.

Figure 10:
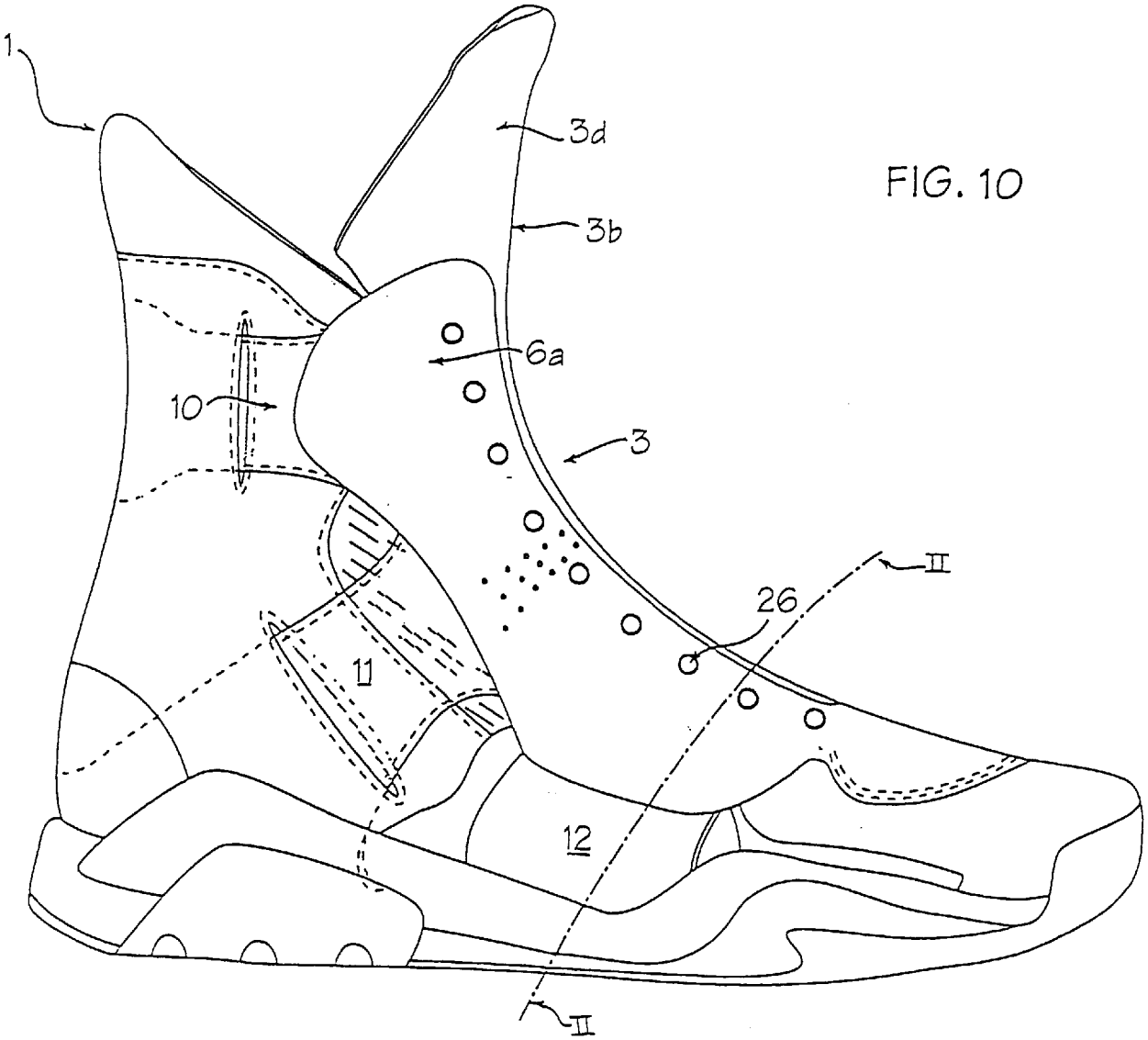
FIG. 10 is a lateral side elevational view of a third embodiment of the present invention disclosed in FIG. 1 providing alternative lacing holes on elongated flange portions of the tongue.
Figure 11:
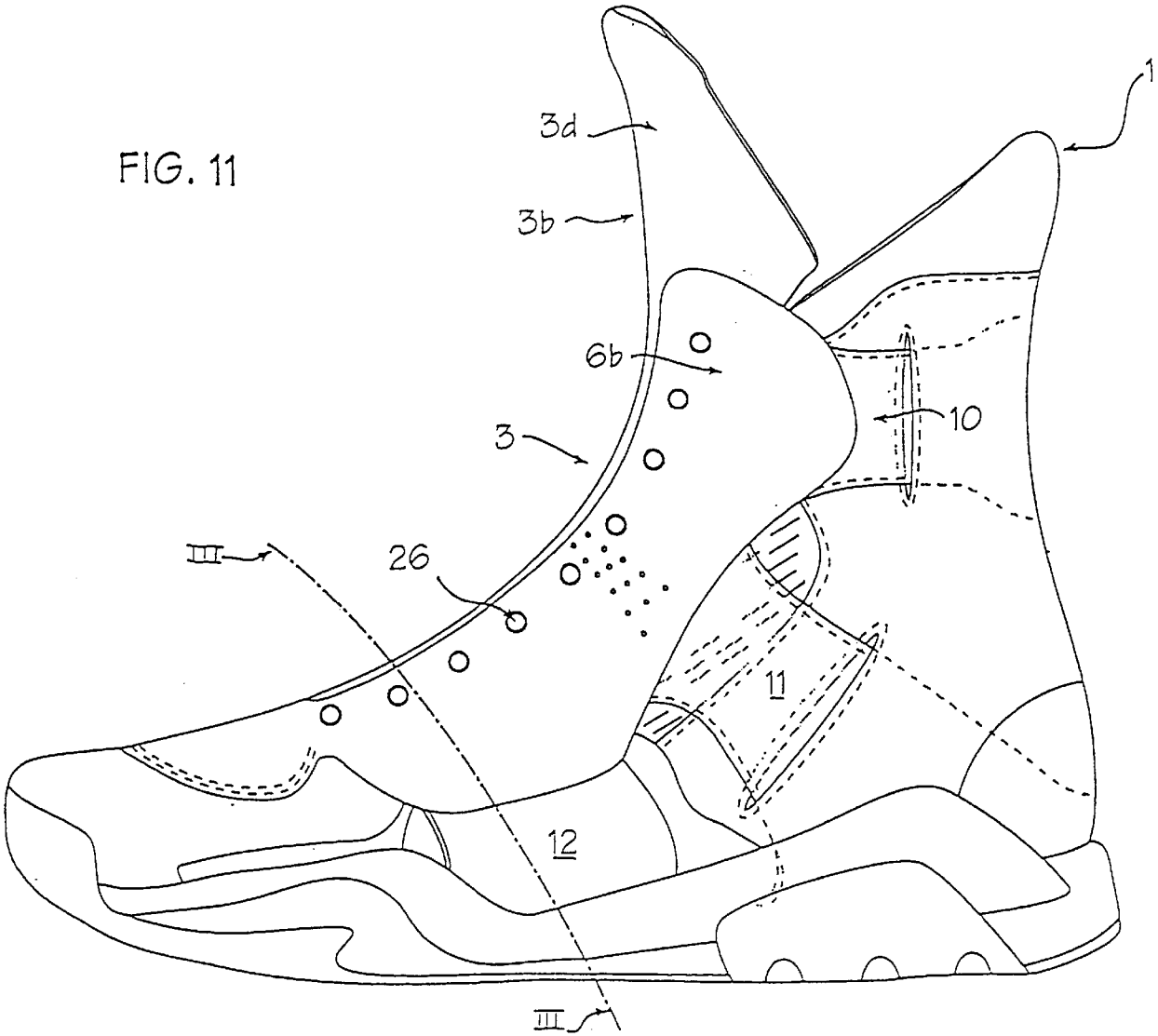
FIG. 11 is a medial side elevational view of the article of footwear disclosed in FIG. 10.
Figure 12:
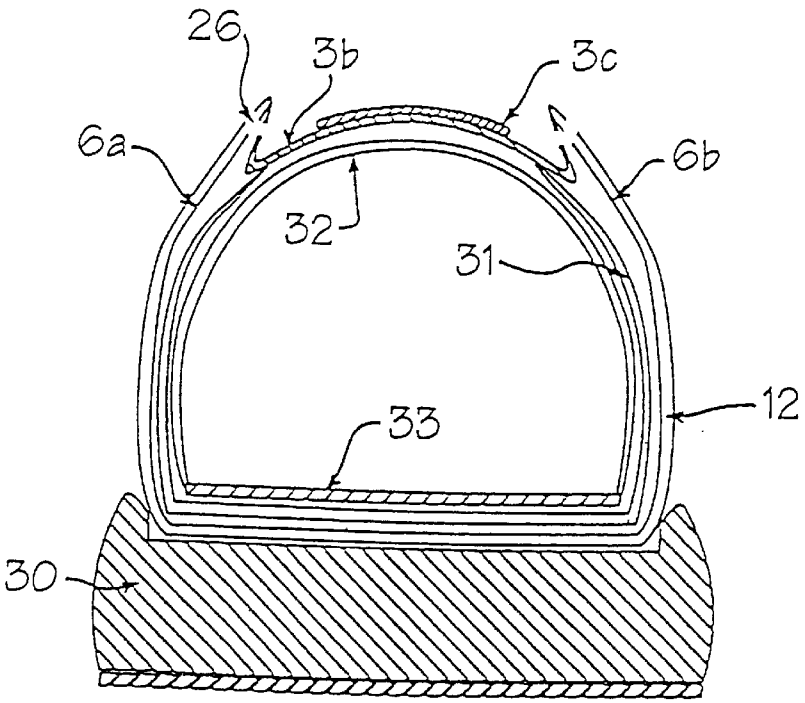
FIG. 12 is a partial cross-sectional view taken along line B—B in FIG. 10.

The third embodiment shown in FIGS. 10 and 11 is substantially identical to the second embodiment shown in FIGS. 8 and 9, but the straps are tensioned via laces, rather than cinching devices. As shown, lace holes 26 are formed in the first and second elongated flange portions 6*a*, 6*b* for receiving laces, in a manner well known in the art. FIG. 12 shows a cross-section along line B—B in FIG. 10. The cross-section shown in FIG. 12 is substantially identical to that shown in FIG. 4 according to the first embodiment, however, the instep strap 12 is connected directly to the tongue, that is, to first and second elongated flange portions 6*a*, 6*b*. In addition, the instep strap 12 may extend partially through the upper 2 and/or midsole 30, as shown in FIGS. 5 and 6 in connection with the first embodiment.

Figure 13:
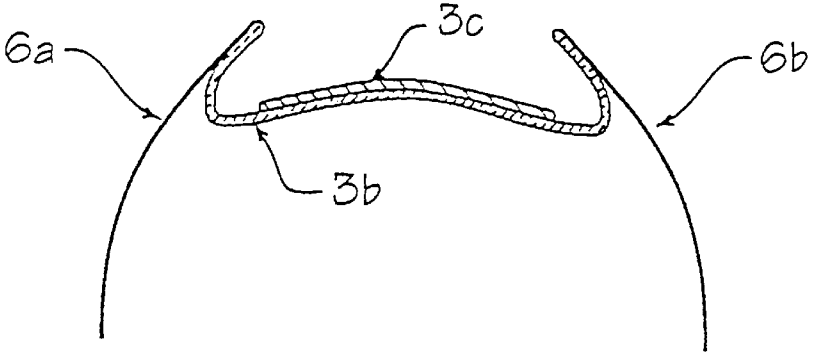
FIG. 13 is a partial sectional view along line C—C in FIG. 11, disclosing the structure of the tongue.

FIG. 13 shows a partial cross-sectional view taken along lines CC in FIG. 11. As disclosed in FIG. 13, layer of thermoplastic 3*c* is connected to tongue inner 3*b* located between and attached to elongated flange portions 6*a*, 6*b*.

Figure 14:
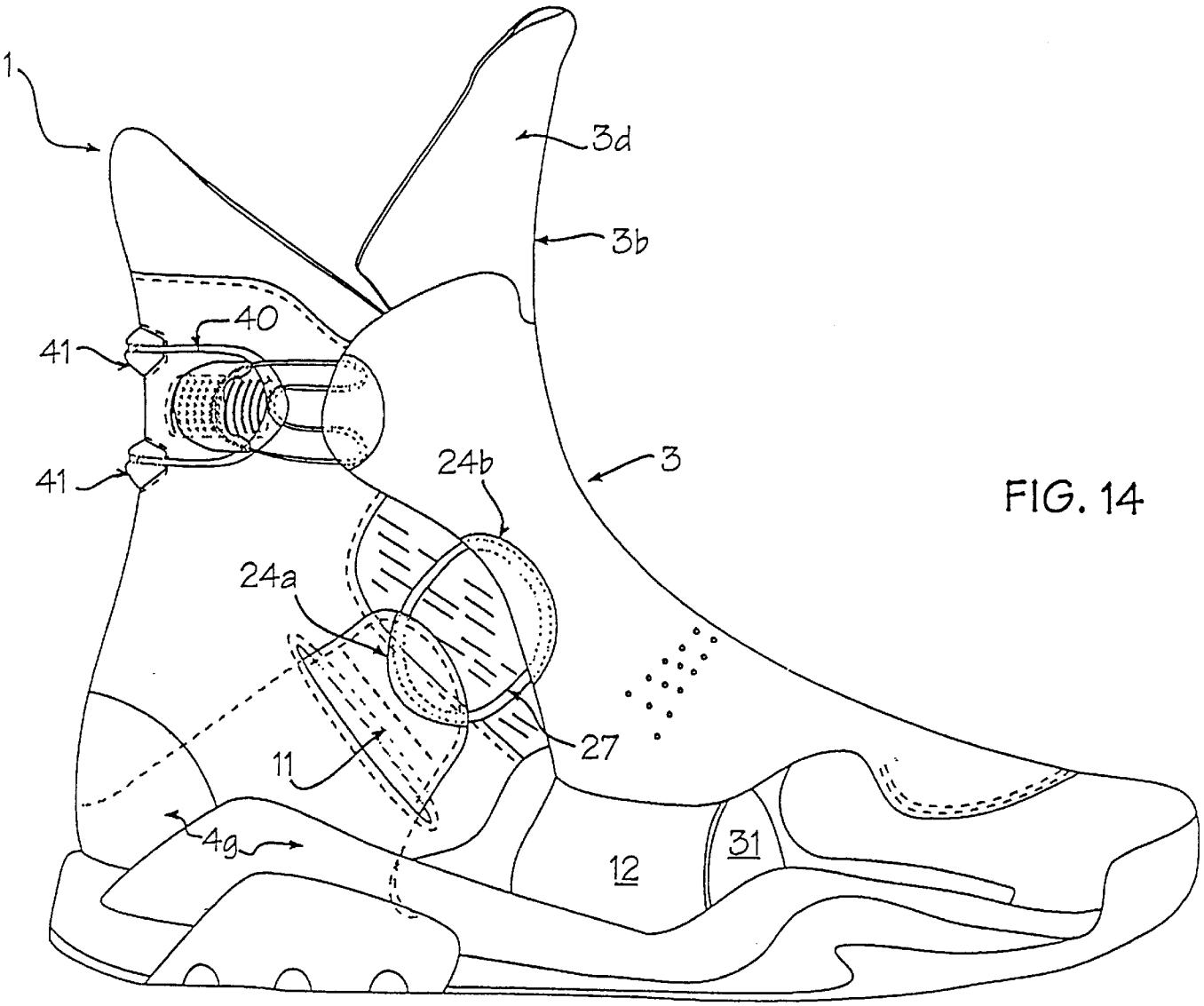
FIG. 14 is a lateral side elevational view of a fourth embodiment of the present invention disclosed in FIG. 1 providing alternative cinching devices for securing the straps to the tongue of an article of footwear.
Figure 15:
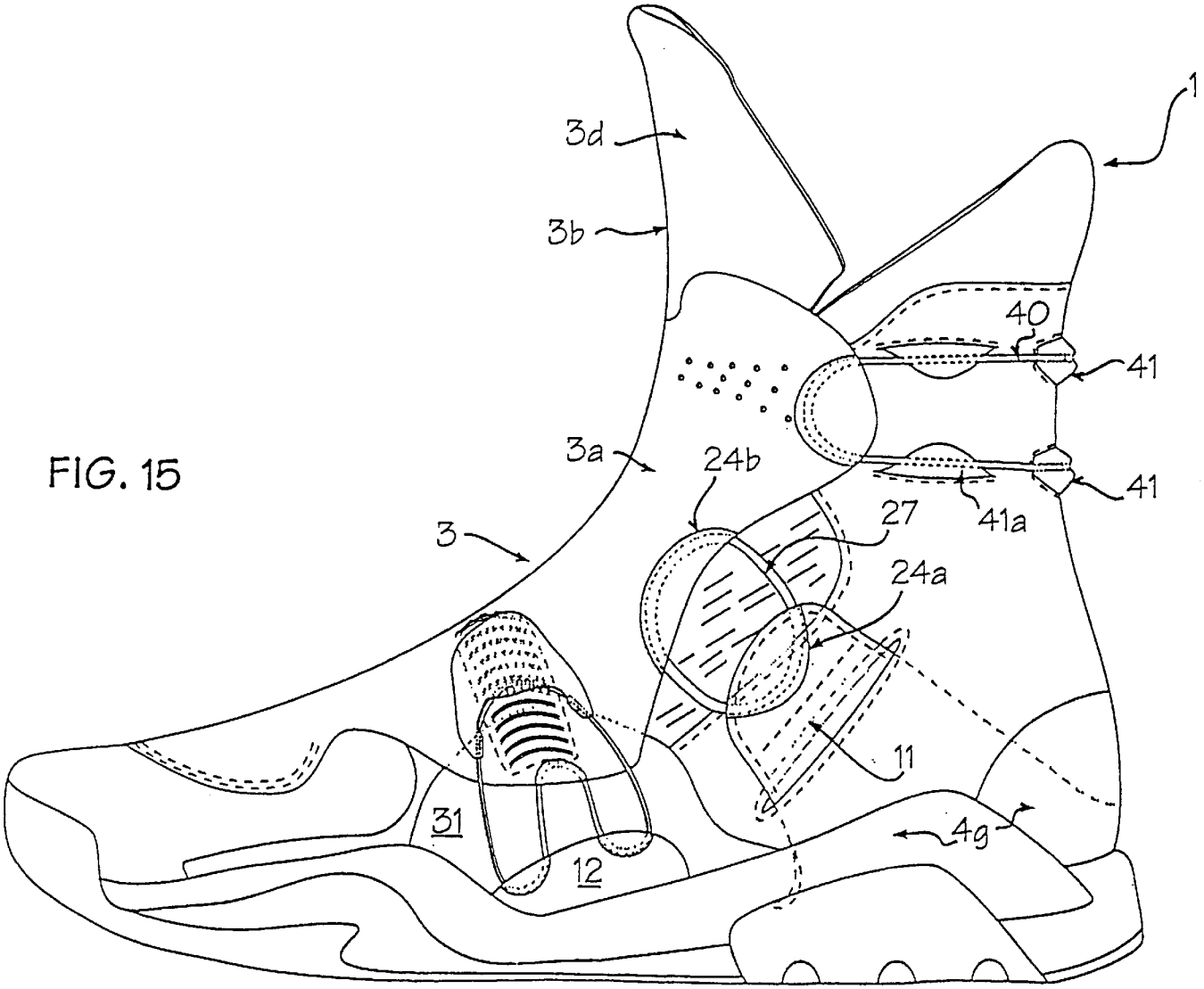
FIG. 15 is a medial side elevational view of the fourth embodiment disclosed in FIG. 14, providing groove-forming members for alternative cinching devices.

FIGS. 14 and 15 show a fourth embodiment of the present invention. In this particular embodiment, heel strap 11 is connected to the tongue overlay 3*a* via elastic loops 27, each of which extends through channels in the heel strap 11 and tongue overlay 3*a*. The elasticity of elastic loop 27 may vary depending upon the size of the article of footwear, and/or differences among athletic purposes for which the article of footwear is designed. The elastic loop 27 may include a nylon cover for greater durability and movement. In this particular embodiment, the heel strap may be free floating between two layers of the upper or connected to orthotic 31 or a heel counter 4*g* well known in the art, or the sliplast 33, shown in cross-section FIGS. 4–6.

In addition, the arch and instep strap 12 has a first end connected by adhesive and/or stitching, or other conventional means, directly to the tongue overlay 3*a* and a second end being adjustably secured to the tongue overlay 3*a* via a cinching device, as disclosed in FIG. 15.

The fourth embodiment shown in FIGS. 14 and 15 includes a strap element in the form of an elastic cord 40 which extends around the outside of ankle portion of the upper. Elastic cord 40 is clipped into grooves formed in groove-forming members 41 and 41*a*, which may be formed of a high flexural modulus elastomer such as LOMOD available from General Electric Plastics. As disclosed in FIG. 15, a cinching device is adapted to connect the elastic cord 40 to the tongue overlay 3*a*. Similar to elastic loop 27, suitable elastic strengths of elastic cord 40 may be appropriately utilized depending upon the athletic purpose for which the article of footwear is designed.

Figure 16:
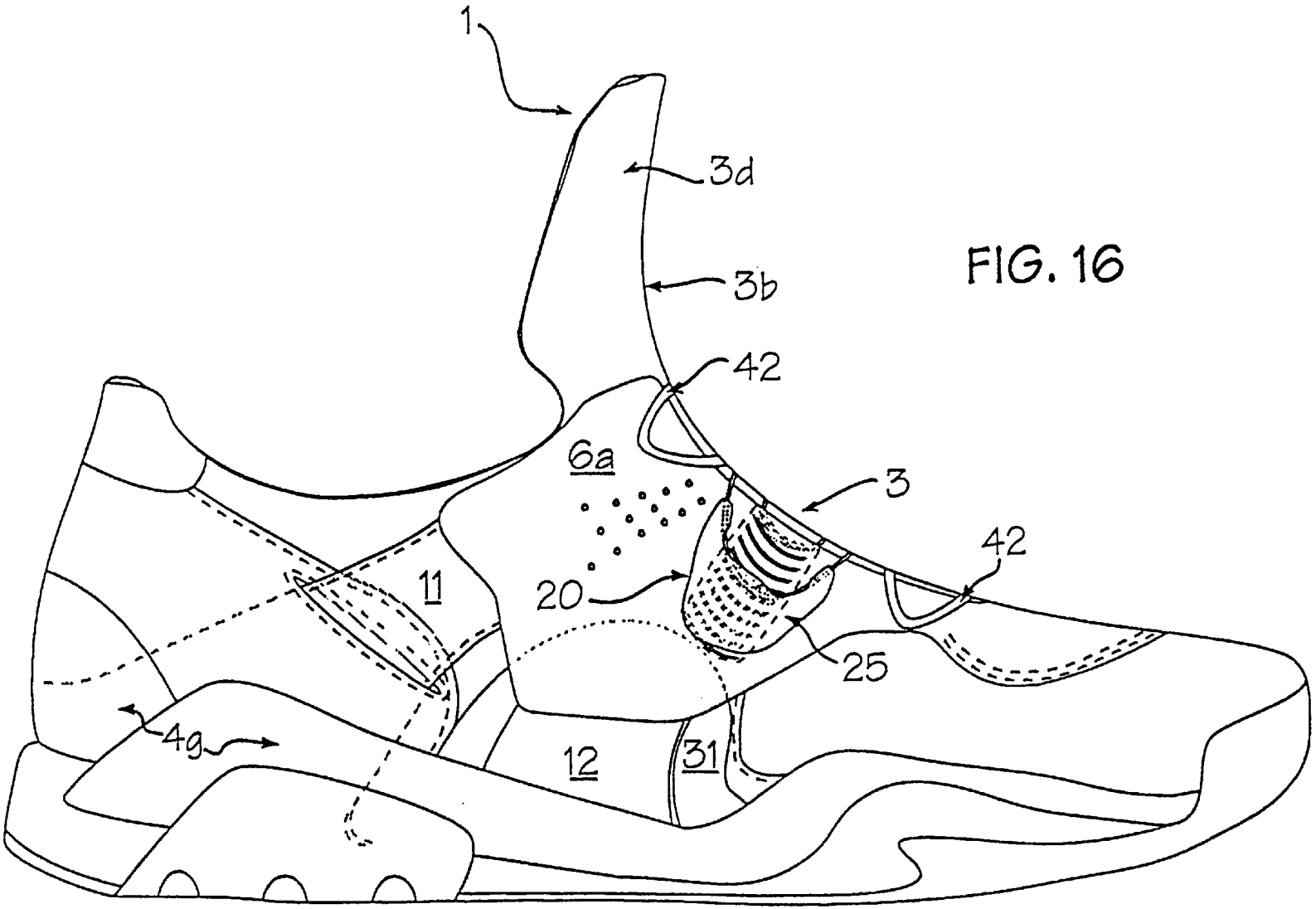
FIG. 16 is a lateral side elevational view of a fifth embodiment of the present invention disclosed in FIG. 1, disclosing a low-cut or oxford style running shoe.
Figure 17:
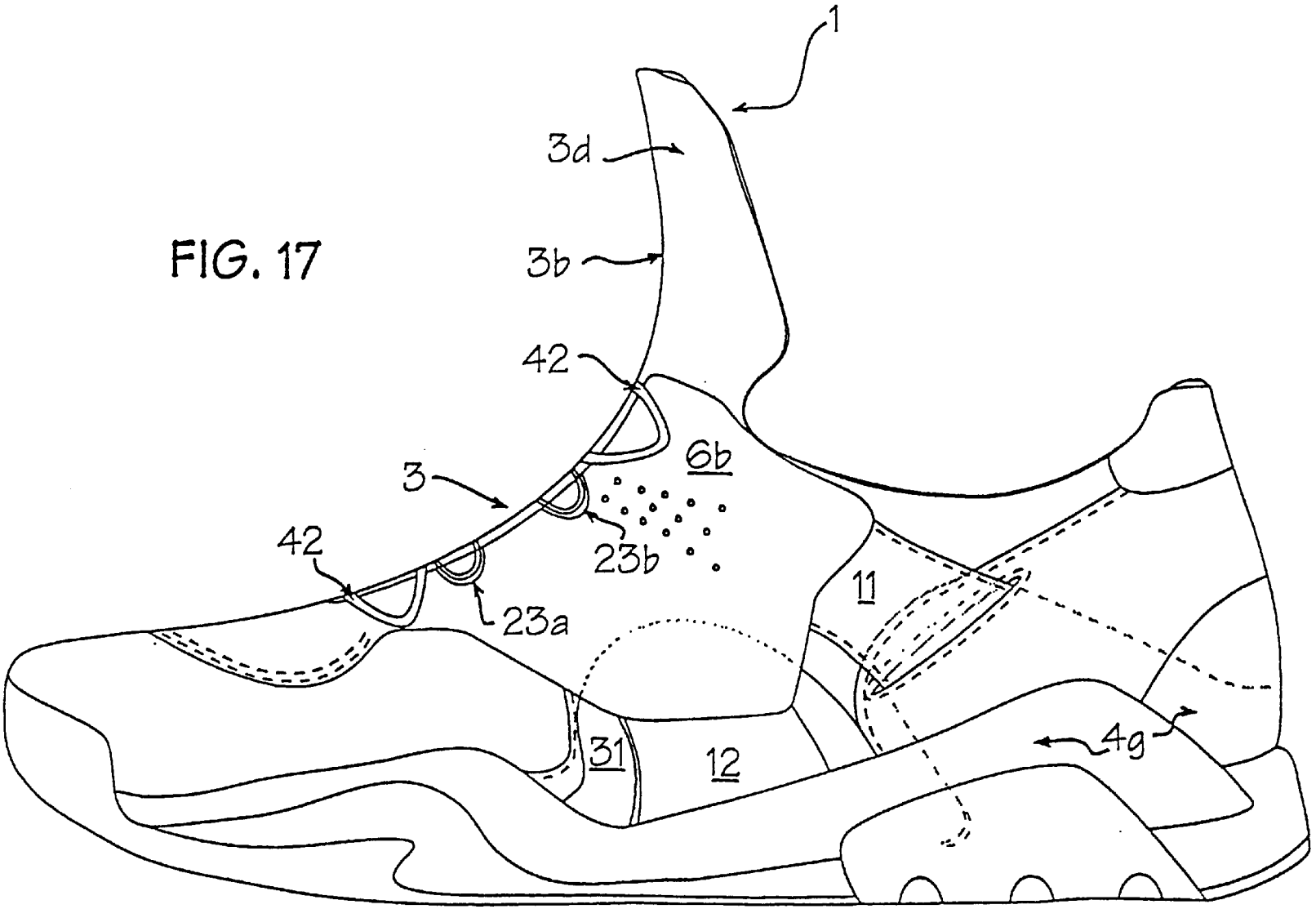
FIG. 17 is a medial side elevational view of the article of footwear disclosed in FIG. 16.

Although the embodiments previously described are drawn to high-top articles of footwear, the present invention may also be adapted for low-cut or oxford type footwear, such as running or cycling footwear or three-quarter mid-height articles of footwear such as hiking or CROSS-TRAINING shoes. FIGS. 16 and 17 disclose a low-cut or Oxford type article of footwear, wherein cinching device 20 is formed to connect first and second elongated flange portions 6*a*, 6*b*. In addition, tongue loops 42 may be provided between the first and second elongated flange portions, tongue loops 42 being formed of an elastic material.

Figure 18:
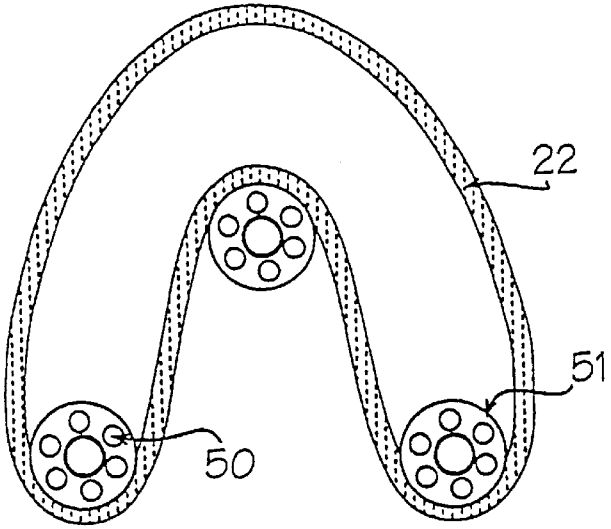
FIG. 18 is a schematic view of an alternative cinch device according to the present invention.

FIG. 18, discloses an alternative embodiment of the cinching devices, wherein cable 22 extends around synthetic or alloy roller bearings 50 which replace the first, second and opposite guide members 23*a*–*c* disclosed in FIGS. 1–3 and 14–17. The pulley 51 is preferably composed of thermoplastic such as NYLON GLASS FIBER, available from LNP Engineering Plastics. Cable 22 may be formed of nylon, elastic, or braided metallic cord, natural cord or a combination thereof. The purchase of the cinching mechanism may be at least 1:1, but preferably 2:1 or 3:1 to gain an adequate mechanical advantage from the device.

Figure 19A:
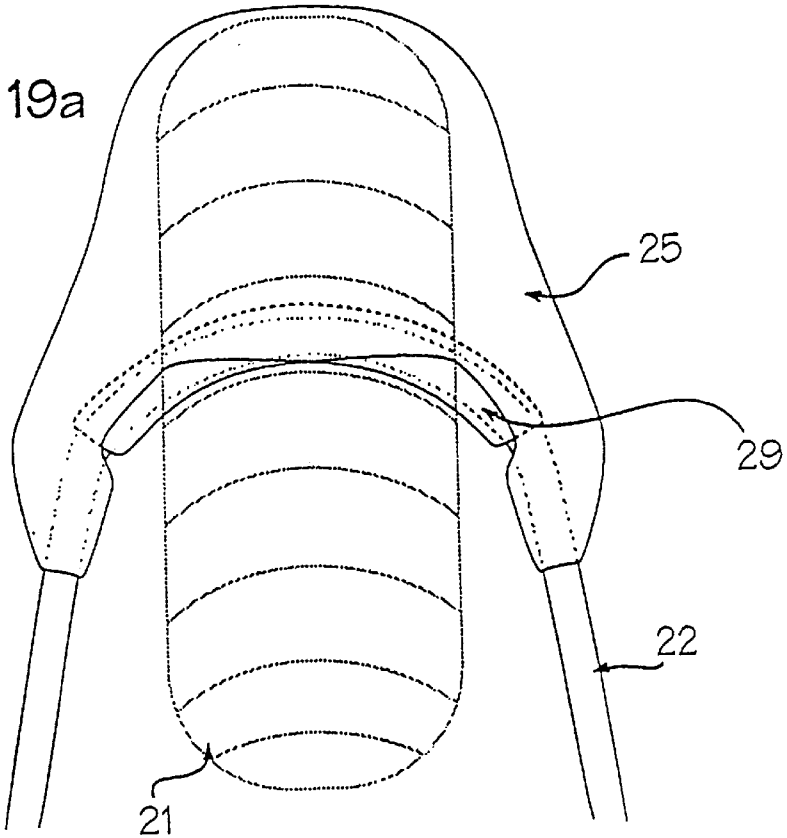
FIGS. 19A and 19B are partial top and side views of the connecting structures of the cinch device according to an embodiment of the present invention.
Figure 19B:
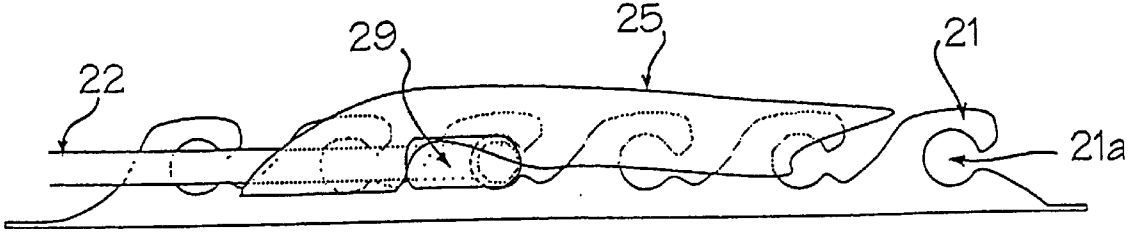

FIGS. 19*a* and 19*b* show a detailed view of the device between the cable 22, including tab 25 and clip-in grooves 21*a* formed in ratchet 21. Tab 25 comprises an outer peripheral edge which bounds sides of the ratchet 21. Clip-in grooves 21*a* are shaped so as to permit the closed loop portion of the cable to clip therein, as fully shown in FIG. 19*b*.

Figures 20A, 20B:
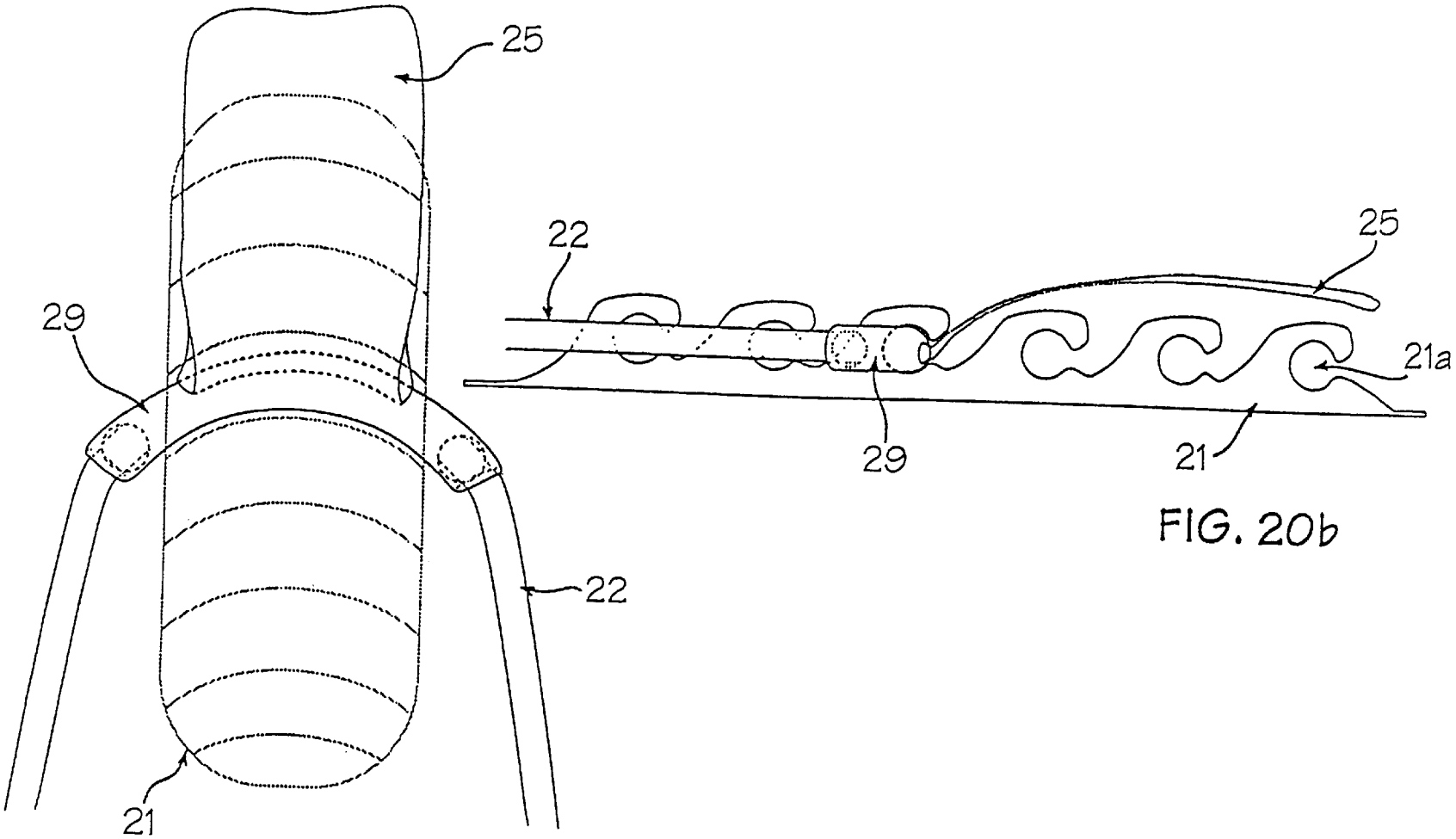
FIGS. 20A and 20B are partial top and side views of alternative connecting structures of the cinch device according to an embodiment of the present invention.

FIGS. 20*a* and 20*b* show yet another alternative embodiment for the device between the cable 22 and the ratchet 21. In this particular variation, the cable 22 is connected to a bridging member 29, which may formed of thermoplastic material. Pull tab 25 extends from bridging member 29. Bridging member 29 includes an outer diameter sized to clip into grooves 21*a*, similar to the embodiments shown in 19*a* and 19*b*.

Figure 21:
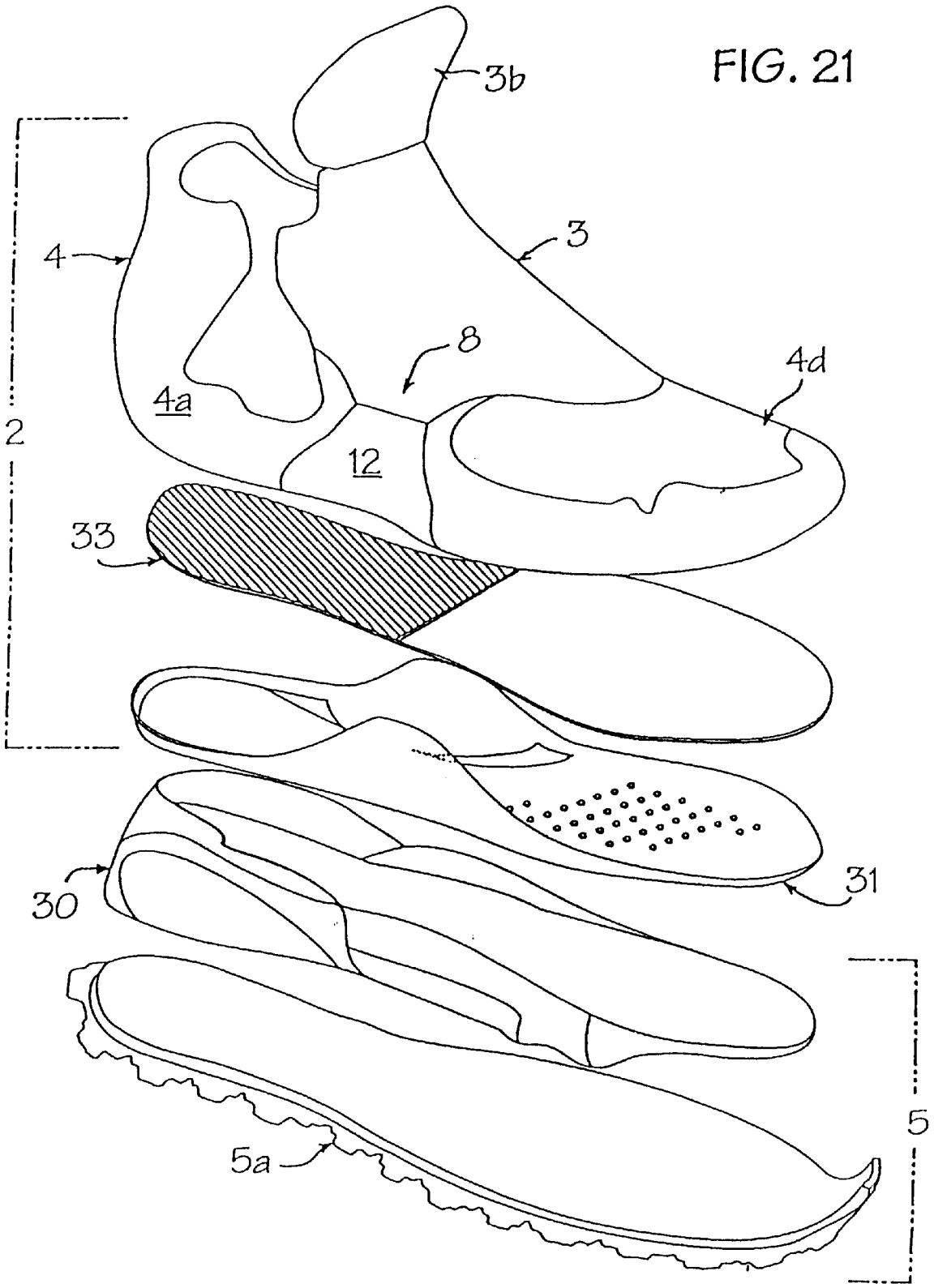
FIG. 21 is an exploded perspective view showing a layered structure of the upper and sole including midsole and outsole.

FIG. 21 shows a preferable arrangement of layers of the sole and upper. As shown, the sole 5 includes midsole 30 and outsole 5*a*, while upper 2 includes upper body 4, sliplast 33 and orthotic 31. The sliplast 33 is sandwiched between orthotic 31 and upper body 4. As known in the art, the sliplast 33 and upper body 4 are secured together in moccasin fashion and attached to the midsole 30, providing a high degree of comfort and cushioning. Alternative arrangements of the layers are also contemplated. For example, the sliplast 33 of the sock liner 32 may be eliminated, and the upper body 4 may be secured (e.g., sewn) directly to the orthotic. In this case, the midsole may be eliminated as in ice skates and ski boots.

According to each of the embodiments of the present invention, the ankle, heel, arch and instep straps fully wrap around the upper of an article of footwear, and are-integrated with the tongue. It should be understood by one skilled in the art that the present invention discloses an integrated tongue-strap structure that applies very even pressure about the dorsal or top portion of the foot, the medial and lateral sides, and sole of the foot comprising the entire circumference of the wearer's foot. The straps may partially contact the foot of the wearer, but preferably generally extend into the upper body or between the upper and the sole such that the tension applied to the straps is distributed over relatively large area, thereby providing a superior fit. In addition, the one-piece structure of the straps is made possible by the manner in which the straps connect to the tongue or the specific tensioning means provided along a composite tongue which is thereby cinched. Thus, the straps need not be severed to permit the donning and removing of an article of footwear by the wearer, which is required by the prior art.

While particular embodiments of the present invention have been shown and described previously, various modifications to the embodiments may be made as would occur to those skilled in the art upon reviewing the present disclosure. Such variations, within the spirit of the present invention, are intended to be encompassed by the scope of the appended claims, the preferred embodiments being provided for illustrative purposes only.

What is claimed is:

1. An article of footwear, comprising:

an upper including (i) an upper body including a heel portion, an instep portion and a toe portion for respectively receiving a heel, an instep, and toes of a foot of a wearer, and (ii) a tongue attached to the upper body, for covering a dorsal portion of the foot;

a sole connected to the upper;

a strap element substantially coincident with the periphery of said upper and having first and second opposite ends positioned proximate first and second side portions of said tongue, respectively;

guide members formed in at least one of said first and second opposite ends of said strap element and in at least one of said first and second side portions of said tongue, respectively;

an effective closed-loop cable passing through said guide members; and anchor means for releasably receiving a portion of said cable to tension said strap element, wherein said cable is completely separable or disengageable from said anchor means.

2. The article of footwear according to claim 1, wherein said anchor means is located on said upper.

3. The article of footwear according to claim 1, wherein said anchor means is located on said tongue.

4. The article of footwear according to claim 1, wherein said anchor means is located on said strap element.

5. The article of footwear according to claim 1, further comprising a gripping member attached to said cable proximate said portion releasably received in said anchor means.

6. The article of footwear according to claim 1, wherein said strap element is a one-piece strap element.

7. An article of footwear, comprising:

an upper including (i) an upper body including a heel portion, an instep portion and a toe portion for respectively receiving a heel, an instep, and toes of a foot of a wearer, and (ii) a tongue attached to the upper body, for covering a dorsal portion of the foot, said tongue having a composite structure, including at least first and second elongated flange portions; a sole connected to the upper;

a strap element substantially coincident with the periphery of said upper and having first and second opposite ends secured to said first and second elongated flange portions, respectively;

guide members formed in said first and second elongated flange portions; an effective closed-loop cable passing through said guide members; and anchor means for releasably receiving a portion of said cable to tension said strap element, wherein said cable is completely separable or disengageable from said anchor means.

8. The article of footwear according to claim 7, wherein said anchor means is located on said upper.

9. The article of footwear according to claim 7, wherein said anchor means is located on at least one of said first and second elongated flange portions.

10. The article of footwear according to claim 7, wherein said anchor means is located on said strap element.

11. The article of footwear according to claim 7, further comprising a gripping member attached to said cable proximate said portion releasably received in said anchor means.

12. The article of footwear according to claim 7, wherein said strap element is a one-piece strap element.

* * * * *